United States Patent [19]

Warchol

[11] Patent Number: 4,486,246

[45] Date of Patent: Dec. 4, 1984

[54] POLYOXAZOLINES IN AQUEOUS QUENCHANTS

[75] Inventor: Joseph F. Warchol, West Norriton, Pa.

[73] Assignee: E. F. Houghton & Co., Valley Forge, Pa.

[21] Appl. No.: 561,980

[22] Filed: Dec. 16, 1983

Related U.S. Application Data

[63] Continuation-in-part of Ser. No. 495,679, May 18, 1983, abandoned.

[51] Int. Cl.[3] ..... C21D 1/56

[52] U.S. Cl. ..... 148/18; 148/20.6; 148/28; 528/402

[58] Field of Search ..... 148/18, 20.6, 28; 528/402

[56] References Cited

U.S. PATENT DOCUMENTS

| | | | |
|---|---|---|---|
| 3,220,893 | 11/1965 | Blackwood et al. | 148/20.6 |
| 3,483,141 | 12/1969 | Litt et al. | 528/402 |
| 4,087,290 | 5/1978 | Kopietz et al. | 148/20.6 |
| 4,381,205 | 4/1983 | Warchol | 148/20.6 |
| 4,404,044 | 9/1983 | Warchol | 148/20.6 |

OTHER PUBLICATIONS

Chem. Rev., 71, No. 5, 483-505, 1971.
Polymer Letters, 4, 441-5, 1966.

*Primary Examiner*—Veronica O'Keefe
*Attorney, Agent, or Firm*—Howson and Howson

[57] ABSTRACT

Metal, such as steel, is quenched in a quenching bath comprising an aqueous solution of a substituted oxazoline polymer, one example of which is polyethyloxazoline having a molecular weight of 50,000 to 500,000. The bath is capable of providing quenching effects similar to those produced by oil quenchants, as well as quenching times between those provided by oil and water.

8 Claims, No Drawings

POLYOXAZOLINES IN AQUEOUS QUENCHANTS

This application is a continuation-in-part of application Ser. No. 495,679 filed May 18, 1983, now abandoned.

DESCRIPTION

Background of the Invention

This invention relates to the heat treatment of metals, and more particularly to a novel process for quenching metals.

In order to modify the physical properties of metals and their alloys, various methods of heat treatment have been devised in which the metal is heated to a given elevated temperature and then cooled. Generally the cooling takes place at a relatively rapid rate, and such cooling is commonly referred to as "quenching". Quenching is accomplished by immersing the hot metal in a liquid bath, usually water or oil.

Water alone produces very rapid cooling and is not suitable for quenching many types of steel, for it produces excessive strains which warp and crack the steel. Hydrocarbon oils provide a relatively slow rate of cooling which is desired to produce certain physical properties, such as ductility, in steel. However, the slower cooling rate provided by oil quenching, although it prevents excessive strains in the metal, often prevents development of the deired hardness.

It, therefore, is desirable to provide quench liquids which will cool the metal at rates similar to oil, or intermediate between oil and water, while achieving the greatest degree of hardness without warping or cracking the steel. To this end various aqueous solutions and dispersions of organic compounds have been proposed as quenching fluids. Such aqueous solutions and dispersions approach the quenching properties of oil, but without the disadvantages of the fire, smoke and fumes associated with the use of oil.

For example, U.S. Pat. No. 3,220,893 discloses a liquid quenching medium comprising an aqueous solution of a liquid oxyalkylene polymer having both oxyethylene and higher oxyalkylene groups and a molecular weight of 12,000 to 14,000. Such compounds are also referred to as polyether polyols and poly(oxyethylene-oxyalkylene)glycols. According to the patent, the oxyalkylene polymers have the characteristic of decreasing in solubility as the temperature of the quenching bath is increased, as when red hot metal is introduced therein. The oxyalkylene polymers are said to form a covering over the metal surface to the exclusion of the water component of the bath. The polymer layer is said to be an excellent heat conducting medium which operates at a high rate, and thus use thereof requires relatively short quench cycle time, which results in minimum internal stress and distortion of the metal, while at the same time imparting uniform hardenability of the metal.

Such nonionic oxyalkylene polymer quenchants control cooling rate of the metal not only by such inverse solubility with temperature, but also by increasing the viscosity of the water in which they are dissolved. Accordingly, it has been the practice to use large amounts of polymer, e.g. 10 to 15% by weight. In use, such relatively concentrated baths suffer from the disadvantage of "drag out", i.e. the polymer is removed with the metal being quenched resulting in undesirable changes in bath viscosity and the necessity for treatment of resulting effluent from washing of the quenched metal to remove adhering polymer. Very high molecular weight nonionic polyoxyalkylene glycols can be used, but the increase in viscosity they cause make them impractical.

It has been suggested to increase the quench cycle time by use of organic compounds which cause the formation of a vapor blanket about the metal during the quenching operation. An example of such an organic compound is a water-soluble polyacrylate, such as a sodium polyacrylate, the use of which compound in a quenching bath comprises the subject matter of U.S. Pat. No. 4,087,290.

An object of this invention is the provision of a novel quenching process employing a quenching bath which can be varied in composition to provide a broad range of quenching rates from that of oil toward that of water.

Another object of this invention is to provide aqueous quenching baths by means of which cooling rates comparable to those provided by oil can be obtained at relatively low bath viscosities.

Another object of the invention is to provide a novel process for quenching heated metal to obtain quenched metal parts of the desired physical properties and having a clean, bright metallic surface.

These and other objects will become apparent from the following description and appended claims.

According to this invention there is provided a novel quenching process useful in the heat treatment of metals. In the process the metal is heated to an elevated temperature and then quenched in a bath comprising an aqueous solution containing from about 0.5% to 5%, by weight, of a water-soluble or water dispersable, nonionic substituted oxazoline polymer having units of the general formula

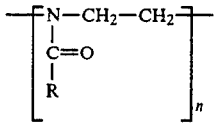

where R is an organic radical which does not significantly decrease the water-solubility or water-dispersibility or nonionic character of the polymer. Usually R will be a substituent selected from the group consisting of a phenyl group or an alkyl group containing from 1 to 7 carbon atoms which may be halogen substituted, although R is not necessarily limited to such groups, and n is an integer such as to provide said polymer with a molecular weight of from about 5000 to about 1,000,000, preferably 50,000 to 500,000, the substituent R in at least about 50 percent of said units in said polymer being alkyl containing from 1 to 3 carbon atoms. Particularly preferred baths according to the invention contain from about 1.5% to about 3%, by weight, of an alkyloxazoline polymer having a molecular weight of from about 200,000 to about 500,000 and in which the alkyl group R contains from 2 to 3 carbon atoms.

It was discovered that the nonionic substituted oxazoline polymers used in the quenching bath of the novel process of this invention provide the same quenching effect as the prior known oxyalkylene glycol polymer quenchants, but with use of only one half to one third the amount of polymer. Surprisingly, it was also discovered that the quench baths used in the process of the present invention have significantly lower viscosities than the baths containing oxyalkylene glycol polymers for a given quenching rate.

As noted above, certain aqueous quenching baths containing organic polymers tend to produce an extended vapor phase during initial quenching of the metal (first part of cooling curve). Oil quenching baths, on the other hand, provide a desirable short vapor phase and an extended convection phase. The latter is extremely important where low hardenability alloys are concerned and softer micro-structures are to be avoided.

Surprisingly, the quenching baths of this invention containing substituted oxazoline polymers were found to exhibit a relatively short vapor phase similar to oil quenchants and also an extended convection stage which is more pronounced at higher temperatures. Thus, the quenching baths of this invention find utility where other aqueous baths containing polymers are unsatisfactory.

The nonionic oxazoline polymers used in the aqueous quenching baths according to this invention are water-soluble, or at least dispersible in water at the concentrations employed in the quenching process. These polymers can be either substituted oxazoline homopolymers or copolymers. In either event, the polymers have recurring units of the general formula

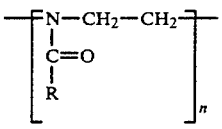

where R is any organic radical which does not significantly decrease the water-solubility or water-dispersibility of the polymers, or render them ionic. Generally, R will be a substituent selected from the group consisting of a phenyl group or an alkyl group containing from 1 to 7 carbon atoms which may be halogen substituted, and n is an integer such as to provide said polymer with a molecular weight of from about 5000 to about 1,000,000, preferably 50,000 to 500,000, the substituent R in at least about 50 percent of said units being alkyl containing from 1 to 3 carbon atoms. Thus, the polymers used in the quenching baths may be homopolymers or copolymers depending upon whether the substituents R are the same for all units or are different. In the case of copolymers they may be either heteric or block copolymers.

As stated above, the substituent R may be alkyl, such a methyl, ethyl, propyl, butyl, isobutyl, etc. and halogenated alkyl, such as 1-chloroethyl, 1-chloro-n-butyl, and the like. In addition, the substituent R may be a phenyl group.

Particularly preferred nonionic oxazoline polymers employed in the quenching bath of this invention are polyethyloxazolines having molecular weights in the range of about 200,000 to about 500,000. Such homopolymers are thermoplastic, amorphous solids which are water-soluble and have a low toxicity.

The monomers from which the polymers used in the quenching baths of this invention are formed may be prepared according the procedures described in *Chemical Reviews* 71 No. 5, pages 483–505 (1971), incorporated herein by reference.

The polymers, whether homopolymers or copolymers, used in the quenching process of this invention may be prepared by polymerizing the monomers or comonomers in a suitable manner. According to U.S. Pat. No. 3,483,141, the monomers may be reacted in an inert atmosphere in the presence of a cation catalyst at a temperature of about 20° C. to 250° C. See also *Polymer Letters* 4, pages 441–445 (1966).

Suitable illustrative monomers include 2-methyl, 2-ethyl, and 2-isobutyl-2-oxazoline and mixtures of these monomers.

The polymerization temperature preferably is in the range of from about 80° C. to 250° C., with reaction times of several hours, which reaction time can vary somewhat depending upon the reactants, polymerization temperature, catalyst type and concentration, and the desired molecular weight.

Typical of the cationic catalysts which may be used in the polymerization reaction are alkyl halides such as methyl iodide and 1,4-dibromobutane; boron-fluorine compounds such as boron trifluoride etherate, strong acids such as p-toluene sulfonic acid,.sulfuric acid, nitric acid and the like. The concentration of catalyst can vary considerably so that the mol ratio of monomer to catalyst is from aobut 10:1 to 60,000:1.

In the quenching baths used in the process of this invention, the concentration of substituted oxazoline polymer can vary from about 0.5% to about 5%, by weight of the bath. Preferred concentrations of higher molecular weight polymers, e.g. molecular weight in the range of 200,000 to 500,000, are in the range of about 1.5% to 3%. Advantageously, the viscosity of the quenching baths does not increase appreciably with increasing polymer concentration within the above specified ranges, and thus undesirable drag out of polymer in quenching metal is avoided. The quenching rate generally decreases with increasing concentrations of the substituted oxazoline polymer. It also decreases as the molecular weight of the polymer increases. The quenching rate also generally decreases with increasing quenching bath temperature measured prior to contact with the immersed hot metal, the preferred range of quenching bath temperatures being about 70° F. to 140° F. (21° C.–60° C.) for most practical uses.

By adjustment of the above-mentioned factors of temperature of the quenching medium, and molecular weight and concentration of the substituted oxazoline polymer used in the quenching medium, a comparatively wide range of cooling rates can be obtained, from the cooling rate for oil to rates lying between those for water and oil.

In addition to the essential substituted oxazoline polymer, the aqueous quenching baths used in the invention may contain other additives to improve performance in certain applications. For example, there may be added to the baths corrosion inhibitors such as sodium nitrite, ethanol amine or amine soaps, which prevent corrosion of quench tanks, conveyor belts and the quenched parts, as well as other additives, including defoamers, biocides, metal deactivators, etc.

The following example more fully describes the quenching process of this invention, but is not to be construed as in any way limiting the scope of the invention.

TEST PROCEDURES

In each test where cooling time was determined, the test specimen was a cylinder 500 millimeters long and 10 millimeters in diameter, and composed of scaleproof austenitic steel. A microthermocouple was inserted into the center of the cylinder, and in the case of Example I, the temperature-representing output of the thermocouple was recorded by means of a strip chart recorder (Chessell 321). In the case of Example III, the curves were computer (Commodore) plotted on a display (Panasonic) in place of the strip chart recorder. The test specimen was heated in an electric resistance furnace which was operated without a controlled atmosphere and adjusted to a temperature of about 1700° F. (925° C.). In each test, the test specimen at the time of immersion in the quenchant was 1620° F. (849° C.). The quantity of quenchant used was 0.5 liters, and the temperature of the quenchant was 80° F. (27° C.).

Cooling curves were obtained using the above test conditions and aqueous solutions of various substituted oxazoline polymers. Cooling times during which the test specimens were cooled from 1600° F. (871° C.) to 400° F. (204° C.) were determined from the cooling curves. The results obtained are described hereinbelow.

EXAMPLE I

Six quenching baths were prepared. Baths A, B and C comprised aqueous solutions of a polyoxyethylenepolyoxypropylene glycol, the concentration of polymer in the baths being 11.7%, 5.9% and 3.9%, by weight, respectively. Baths D, E and F comprised aqueous solutions of polyethyloxazoline (M.W. 200,000), the concentrations thereof being 3.0%, 2.3% and 0.75%, respectively. Baths G, H and I comprised aqueous solutions of another polyethyloxazoline (M.W. 500,000), and the bath concentrations were 2.0%, 1.5% and 0.5%, respectively. Viscosities for the several baths were determined and cooling times were obtained using the procedure described hereinabove. The data obtained as a result of such tests is set forth in Table I, below

TABLE I

| Bath | Bath Concentration* | Viscosity (cSt) (100° F.) (37.8° C.) | Cooling Time (sec.)** Bath T. (80° F.) (26.7° C.) |
|---|---|---|---|
| A | 11.7 | 8.9 | 13.1 |
| B | 5.9 | 3.1 | 7.3 |
| C | 3.9 | 1.9 | 5.3 |
| D | 3.0 | 2.7 | 13.3 |
| E | 2.3 | 2.0 | 7.8 |
| F | 0.75 | 1.0 | 4.1 |
| G | 2.0 | 2.7 | 18.9 |
| H | 1.5 | 2.1 | 12.2 |
| I | 0.5 | 1.0 | 4.1 |

*Cloud points for all polymers were in the range of 140–145° F. (60°–63° C.)
**From 1600° F. to 400° F. (870°–204° C.).

The data in Table I show that when quenching effect is measured in terms of cooling time (usual method) and a quenching time of 12 to 13 seconds is desired, a bath concentration of 11.7% polyoxyalkylene glycol, which bath has a viscosity of 8.9 cSt, is required (see Bath A). By way of contrast, a similar quenching effect (13.3 seconds) can be obtained by means of a bath containing only 3% of a polyethyloxazoline (M.W. 200,000), the viscosity of the bath being only 2.7 cSt (see Bath D). Using a bath containing only 2.0% of a polyethyloxazoline (M.W. 500,000), a quenching time of 18.9 seconds is obtained. However, the viscosity of the bath is only 2.7 cSt. (see Bath G). Thus, using aqueous quenching baths of the present invention which contain substituted polyoxazolines, the same quenching effect can be obtained as that provided by a polyalkylene glycol, but with only one third to one half the quantity of polymer. Of equal importance is the fact that the viscosities of the aqueous baths according to this invention are significantly lower in providing the same quenching effect as a polyoxyalkylene glycol bath. Thus, the process of this invention finds application where aqueous baths based on other polymers are unsuited.

EXAMPLE III

The purpose of this example was to determine the thermal stability of the polymers used in the quenching baths of this invention as compared to certain prior known polymer quenchants.

A 3"×5" rectangular sheet of 1010 carbon steel was placed on a hot plate and heated. Two drops of the following aqueous quenching baths were placed on the metal sheet at various locations.

TABLE II

| Bath | Polymer | Concentrations (Wt %) |
|---|---|---|
| J | polyalkylene glycol | 40 |
| K | polyalkylene glycol | 40 |
| L | polyethyloxazoline* | 15 |
| M | polyethyloxazoline** | 15 |

*M.W. 200,000
**M.W. 500,000

As the metal sheet became hotter, the water vaporized leaving the respective polymers. The alkylene glycol polymers smoked, fumed and finally decomposed to a crust. The oxazoline polymers did not begin to smoke until after the alkylene glycol polymers had become completly carbonized.

EXAMPLE III

Three quenching baths, namely, baths N, O and P, were prepared and comprised aqueous solutions of polyethloxazoline (M.W 50,000), the concentrations of said solutions being 3%, 2% and 1%, respectively. Viscosities for the three baths were obtained using the procedure described hereinabove. The data obtained as a result of such tests is set forth in Table III, below:

TABLE III

| Bath | Bath Concentration* | Viscosity (cSt) (100° F.–37.8° C.) | Cooling Time (sec)** Bath T. (80° F.–26.7° C.) |
|---|---|---|---|
| N | 3 | 1.54 | 7.9 |
| O | 2 | 1.19 | 5.2 |
| P | 1 | 0.91 | 4.1 |

*Cloud points of 145°–150° F. (62.7° to 65.5° C.)
**From 1600° to 400° F. (879° to 204° C.)

The quenching baths of this invention obtain the same quenching effect with one third to one half of the polymer concentration required of alkylene glycol polymer baths. Thus, upon disposal, the baths used in the present invention have reduced environmental impact and require less waste water treatment.

I claim:

1. In the process of quenching which is useful in the heat treatment of metals wherein a metal is heated to an elevated temperature and said heated metal is then quenched in a bath comprising a liquid quenching medium to effect desirable metallurgical changes in the metal, the improvement which comprises using as said quenching medium an aqueous solution containing an effective cooling rate reducing amount of a nonionic, water-soluble or water-dispersible substituted oxazoline polymer having recurring units of the general formula

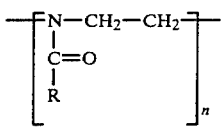

where R is an organic radical which does not significantly alter the nonionic and water-solubility and water-dispersibility characteristics of the polymer when said polymer is present in said concentrations, and n is an integer such as to provide said polymer with a molecular weight of from about 5000 to 1,000,000.

2. A process according to claim 1 in which the concentration of said polymer in said quenching medium is from about 0.5% to 5%, by weight, based on the total weight of the quenching medium, and said polymer has a molecular weight of from about 50,000 to about 500,000.

3. A process according to claim 2 in which the concentration of said polymer in said quenching medium is from about 1.5% to about 3%, and said polymer has a molecular weight in the range of from about 200,000 to about 500,000.

4. In the process of quenching which is useful in the heat treatment of metals wherein a metal is heated to an elevated temperature and said heated metal is then quenched in a bath comprising a liquid quenching medium to effect desirable metallurgical changes in the metal, the improvement which comprises using as said quenching medium an aqueous solution containing an effective cooling rate reducing amount of a nonionic, water-soluble or water-dispersible substituted oxazoline polymer having recurring units of the formula

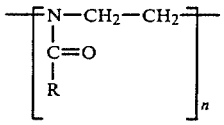

where R is a substituent selected from the group consisting of a phenyl group or an alkyl group containing from 1 to 7 carbon atoms which may be halogen substituted, and n is an integer such as to provide said polymer with a molecular weight of from about 5000 to about 1,000,000, the substituent R in at least about 50 percent of said units in said polymer being alkyl containing from 1 to 3 carbon atoms.

5. A process according to claim 4 in which the concentration of said polymer in said quenching medium is from about 0.5% to about 5%, by weight, based on the total weight of the quenching medium, and said polymer has a molecular weight of from about 50,000 to about 500,000.

6. A process according to claim 5 in which the concentration of said polymer in said bath is from about 1.5% to 3% and said polymer has a molecular weight of from about 200,000 to about 500,000.

7. In a process of quenching which is useful in the heat treatment of metals wherein a metal is heated to an elevated temperature and said heated metal is then quenched in a bath comprising a liquid quenching medium to effect desirable metallurgical changes in the metal, the improvement which comprises using as said quenching medium an aqueous solution containing from about 0.5% to 5%, by weight, based on the total weight of the quenching medium, of a nonionic, water-soluble or water dispersible substituted oxazoline polymer having recurring units of the general formula

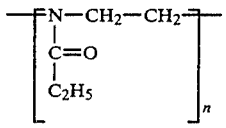

where n is an integer such as to provide said polymer with a molecular weight of from about 50,000 to 500,000.

8. A process according to claim 7 in which the concentration of said polymer in said quenching medium is from about 1.5% to about 3%, and said polymer has a molecular weight of from about 200,000 to 500,000.

* * * * *